US006755414B2

(12) United States Patent
Iwai et al.

(10) Patent No.: US 6,755,414 B2
(45) Date of Patent: Jun. 29, 2004

(54) PAPER SHEET FEEDER

(75) Inventors: Tadahiro Iwai, Hidaka (JP); Noboru Yamagishi, Kawagoe (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 10/148,222

(22) PCT Filed: Aug. 24, 2001

(86) PCT No.: PCT/JP01/07288

§ 371 (c)(1),
(2), (4) Date: May 23, 2002

(87) PCT Pub. No.: WO02/26606

PCT Pub. Date: Apr. 4, 2002

(65) Prior Publication Data

US 2002/0185811 A1 Dec. 12, 2002

(30) Foreign Application Priority Data

Sep. 27, 2000 (JP) ..... 2000-294349
Mar. 22, 2001 (JP) ..... 2001-82890

(51) Int. Cl.[7] ..... B65H 43/00

(52) U.S. Cl. ..... 271/176; 271/177; 271/180; 271/181; 271/265.01; 271/265.02

(58) Field of Search ..... 271/265.02, 176, 271/177, 180, 181, 233; 194/336

(56) References Cited

U.S. PATENT DOCUMENTS 4,331,328 A * 5/1982 Fasig ..... 271/270
4,540,170 A * 9/1985 Masuda et al. ..... 271/259
4,807,736 A * 2/1989 Kondo et al. ..... 194/206
5,186,449 A * 2/1993 Ohmi et al. ..... 271/10.03
5,195,739 A * 3/1993 Watabe ..... 271/207
5,197,726 A * 3/1993 Nogami ..... 271/110
5,323,219 A * 6/1994 Hamanaka et al. ..... 271/256
5,355,206 A * 10/1994 Maruyama et al. .... 271/265.01
5,564,691 A * 10/1996 Hatamachi et al. ..... 271/178
5,575,466 A * 11/1996 Tranquilla ..... 271/10.03
5,709,293 A * 1/1998 Ishida et al. ..... 194/200
5,848,784 A * 12/1998 Tranquilla ..... 271/10.03
5,887,695 A * 3/1999 Hatamachi et al. ..... 194/207
6,076,648 A * 6/2000 Hatamachi et al. ..... 194/206
6,101,426 A * 8/2000 Kimura et al. ..... 271/265.01
6,126,160 A * 10/2000 Ebert et al. ..... 271/10.03

FOREIGN PATENT DOCUMENTS

JP 64-017737 1/1989

* cited by examiner

*Primary Examiner*—Donald P. Walsh
*Assistant Examiner*—Matthew J. Kohnen
(74) *Attorney, Agent, or Firm*—Welsh & Katz, Ltd.

(57) ABSTRACT

A paper sheet feeder (1), comprising a bill feeding means (4) having a motor (11) for feeding a bill (A) as a paper sheet along a bill feeding route (2), a bill detection sensor (15) disposed in the bill feeding route (2), and a control means for stopping the driving of the motor (11) after the bill passes the bill detection sensor (15) and positioning the bill (A) at a specified position on the downstream side of the bill detection sensor (15), wherein the control means (25) controls the driving time of the motor (11) after the bill (A) passes the bill detection sensor (15) based on a time (T1) required for the bill (A) to pass through the specified interval of the bill feeding route (2) positioned on the upstream side of the bill detection sensor (15).

5 Claims, 9 Drawing Sheets

*Prior Art*

PAPER SHEET FEEDER

TECHNICAL FIELD

This invention relates to a paper sheet feeder for conveying paper money and other papers, provided inside a vending machine, money changing machine or game machine.

BACKGROUND ART

In general, a paper money feeder is loaded inside the main bodies of such equipment as vending machines, money changing machines and game machines and the like. The paper money feeder guides paper money inserted through a paper money insertion slot along a paper money feeding route, judge whether the paper money is genuine or counterfeit while guiding that paper money, and guide paper money identified as genuine to a stacker downstream from the paper money feeder.

FIG. 8 is a schematic cross-sectional view of the main parts of a conventional paper money feeder.

This conventional paper money feeder 31 is configured such that it comprises paper money feeding means 4 comprising a motor (not shown) for conveying paper money A inserted through a paper money insertion slot 2*a* along a roughly inverted U-shaped paper money feeding route 2, a paper money detection sensor 15 placed in the paper money feeding route 2, and control means (not shown) for stopping the drive of the motor after the paper money A has passed the paper money detection sensor 15 and positioning that paper money A in a prescribed position downstream from the paper money detection sensor 15.

Of these components, the paper money feeding means 4 are configured by an endless paper money conveyance belt 5 provided under tension along the paper money feeding route 2, paper money conveyance belt drive means 10 comprising pulleys 6, 7, 8, and 9 that turn and drive that paper money conveyance belt 5, a motor (not shown) for imparting drive force to the paper money conveyance belt drive means 10, and an encoder (not shown) for detecting the drive pulse number for that motor.

Reference numeral 13 is a roller that turns in the opposite direction as the paper money conveyance belt 5, being a reinforcing roller that reinforces the paper money conveying force provided by the paper money conveyance belt 5.

The paper money detection sensor 15 comprises a lever 16 that projects toward the paper money feeding route 2, the back end of which lever 16 is supported by a shaft 17 so that it can freely turn.

At this paper money detection sensor 15, when the leading end of the paper money A passes the lever 16, that leading end of that paper money A presses against the fore end of the lever 16, and causes that fore end of that lever to turn counterclockwise about the shaft 17, wherefore that turning is detected and an ON signal is sent to the control means. When the trailing end of the paper money A passes the lever 16, the fore end of the lever 16 turns clockwise about the shaft 17 and returns to its initial position, wherefore that turning is detected and an OFF signal is sent to the control means.

Meanwhile, a paper money identification sensor 18 that is a paper money detection sensor separate from the paper money detection sensor 15 is provided in the paper money feeding route 2 at the position where the paper money conveyance belt 5 is provided, upstream from the paper money detection sensor 15. This paper money identification sensor 18 is configured by photosensors comprising a light emitting element and a light receiving element.

In the paper money feeding route 2 positioned downstream from the paper money detection sensor 15, furthermore, a stacker 19 is provided for accommodating internally therein the paper money A that is genuine. Between that stacker 19 and the paper money detection sensor 15, a paper return prevention lever 20 is interposed which prevents paper money A accommodated inside the stacker 19 from being taken back into the paper money feeding route 2.

The back end of that paper money return prevention lever 20 is supported so that it can freely turn by a shaft 21 provided in the paper money feeder 31, while the fore end of the paper money return prevention lever 20 is oriented toward the paper money feeding route 2 that is at the upper end of the stacker 19.

In the paper money feeding route 2 positioned downstream from the paper money return prevention lever 20 are provided paper money moving means 22 comprising a pressing part 22*a*.

As illustrated in FIG. 8, furthermore, an entry slot sensor 3 is provided in the vicinity of the paper money insertion slot 2*a* that is upstream from the paper money feeding route 2.

To the control means (not shown), meanwhile, are input paper money A insertion information from the entry slot sensor 3, and paper money A travel position information and paper money A genuine/counterfeit identification information from the paper money identification sensor 18. To these control means, furthermore, are input paper money A travel position information from the paper money detection sensor 15 also, and information relating to the drive pulse number to the motor of the paper money feeding means 4 from the encoder (not shown) of the paper money feeding means 4. Vending machine transaction processing information is also input to the control means.

These control means judge whether the paper money is genuine or counterfeit, based on the input paper money A genuine/counterfeit identification information, and also control the drive of the motor of the paper money feeding means 4 and the drive of the paper money moving means 22 based on the results of that judgment and on various other information.

Next, the operation of this conventional paper money feeder 31 is described with the flowchart given in FIG. 9.

In the standby condition, the control means (not shown) in this conventional paper money feeder 31 will be judging whether or not the entry slot sensor 3 has turned ON (step 201), and, when it is judged that the entry slot sensor 3 has turned ON, those control means judge that paper money A has been inserted from the paper money insert slot 2*a* and that the leading end of that paper money A has passed the entry slot sensor 3, and drive the motor of the paper money feeding means 4 so that it turns forward (step 202). Thereupon, the pulleys 6, 7, 8, and 9 of the paper money conveyance belt drive means 10 will turn in the clockwise direction and the paper money conveyance belt 5 will also turn in the clockwise direction, wherefore the paper money A will be conveyed upward along the paper money feeding route 2 by the drive force of the paper money conveyance belt 5. When the leading end of that paper money A passes the pulley 6, that paper money A will be conveyed downward along the paper money feeding route 2.

The control means, meanwhile, after driving the motor of the paper money feeding means 4 in step 202, begin determining whether or not the paper money identification sensor 18 has turned ON (step 203) and, when those means judge that that paper money identification sensor has turned ON, thereupon judge that the leading end of the paper money A has reached the paper money identification sensor 18, perform processing to read in identification information for that paper money A by the paper money identification sensor 18 (step 204), and judge whether the paper money A is genuine or counterfeit.

Then, when the control means have judged that the paper money A is genuine, that paper money A is conveyed further downstream in the paper money feeding route 2, maintaining the forward drive on the motor of the paper money feeding means 4, and a judgment is made as to whether or not the paper money identification sensor 18 has turned OFF (step 205).

When the control means judge in this step 205 that the paper money identification sensor 18 has turned OFF, those control means judge that the trailing end of the paper money A has passed the paper money identification sensor 18, stop the motor of the paper money feeding means 4 (step 206), thereby temporarily hold the paper money A in the paper money feeding route 2, and transition to a so-called paper money escrow condition (step 207). In this paper money escrow condition, the leading end of the paper money A has already passed the paper money detection sensor 15, and that paper money detection sensor 15 is turned ON.

Now, when a product purchase button of the vending machine is pressed while in this paper money escrow condition, the control means judge that a normal transaction has been conducted, discharge the product from the vending machine, and transition to a money storage operation that accommodates the paper money A that was being temporarily held (in escrow) in the paper money feeding route 2 into the stacker 19.

More specifically, the control means again drive the motor of the paper money feeding means 4 forward (step 208), make the paper money conveyance belt 5 turn in the clockwise direction, thereby guide the paper money A farther downstream, and begin determining whether or not the paper money detection sensor 15 has turned OFF (step 209). The control means, upon judging in that step 209 that the paper money detection sensor 15 has turned OFF, judge that the trailing end of the paper money A has passed the paper money detection sensor 15, and, after causing the motor of the paper money feeding means 4 to be driven a prescribed number of pulses determined beforehand from the input of an OFF signal output by the paper money detection sensor 15 (YES in step 210), stop the motor (step 211). The number of motor drive pulses is counted by an encoder in the paper money feeding means 4.

Thereupon, the paper money A the trailing end whereof has been detected by the paper money detection sensor 15 is guided into a slit 22*b* in the paper money moving means 22, and the trailing end of that paper money A stops at a position that is as constant as possible.

Thereupon, the control means, upon driving the pressing part 22*a* of the paper money moving means 22, are able to guide the paper money A piece by piece to the stacker 19 (step 212), and, thereby, can safely accommodate the paper money A inside the stacker 19.

Furthermore, because the trailing end (upper edge) of the paper money A accommodated inside the stacker 19 in this manner is engaged by the fore end of the paper money return prevention lever 20, it is possible to avoid, to the extent possible, the danger of paper money A that has once been accommodated inside the stacker 19 being pressed against by other paper money A accommodated inside the stacker 19 so that it is pushed out into the paper money feeding route 2 so as to interfere with the operation of accommodating the paper money A conveyed next or cause paper money jamming.

When the control means judge that paper money A is counterfeit, those control means drive the motor of the paper money feeding means 4 in reverse, cause the paper money conveyance belt 5 to turn in the counterclockwise direction by the pulleys 6, 7, 8, and 9 that are the paper money conveyance belt drive means 10, and thereby return the counterfeit bill from the paper money insertion slot 2*a*.

When the return button of the vending machine is pressed also, the control means drive the motor of the paper money feeding means 4 in reverse, cause the paper money conveyance belt 5 to turn in the counterclockwise direction, and return the escrowed (temporarily held) paper money A via the paper money insertion slot 2*a*.

Now, based on the conventional paper money feeder 31 described in the foregoing, due to environmental changes in temperature, etc., at the installation site of the vending machine or the like comprising the paper money feeder 31, or to fluctuations in the voltage supplied to the motor of the paper money feeding means 4, the load on that motor will fluctuate, and the speed V wherewith that paper money A is conveyed will fluctuate, wherefore, after it has been detected by the paper money identification sensor that the paper money A has passed, even if the motor is stopped after driving it a predetermined prescribed number of pulses, the inertial force of the motor after the drive has stopped will fluctuate. As a result, there have been cases where it is very difficult to stop the trailing end of the paper money A at a determined position.

In a case where a vending machine comprising a paper money feeder 31 has been installed at a high-temperature site, for example, or the voltage supplied to the motor of the paper money feeding means 4 is high voltage (HV), problems have arisen in that, the load on that motor becomes small compared to cases of normal temperature, and the speed V wherewith the paper money A is conveyed becomes fast, wherefore even when that motor is stopped after driving it a predetermined prescribed number of pulses after detecting passage of the paper money A by the paper money detection sensor 15, the inertial force of the motor after the drive thereto has stopped is larger than in cases of normal temperature, so that the trailing end of the paper money A gets sent further downstream than the determined position, as a consequence whereof the upper edge of that paper money A accommodated inside the stacker 19 is pushed out into the paper money feeding route 2 without being engaged by the paper money return prevention lever 20, whereupon it interferes with the operation of accommodating the paper money A conveyed next, or causes paper money jamming.

In a case where a vending machine comprising a paper money feeder 31 has been installed at a low-temperature site, for example, or the voltage supplied to the motor of the paper money feeding means 4 is low voltage (LV), problems have arisen in that, the load on that motor becomes large compared to cases of normal temperature, and the speed V wherewith the paper money A is conveyed becomes slow, wherefore even when that motor is stopped after driving it a predetermined prescribed number of pulses after detecting passage of the paper money A by the paper money detection sensor 15, the inertial force of the motor after the drive thereto has stopped is smaller than in cases of normal temperature, so that the paper money cannot be sent all the way to the determined position (insufficient feed), and the paper money A cannot be definitely accommodated inside the stacker 19.

This problem of not being able to stop the trailing end of the paper money A at a determined position is not limited to paper money feeders that stop the paper money A in a determined position, but also arises similarly in paper sheet feeders (such as coupon conveyors or gift certificate conveyors) that stop other papers (such as coupons or gift certificates, etc.) at a determined position.

An object of the present invention, which was devised in view of the circumstances described in the foregoing, is to provide a paper processing apparatus capable of stopping conveyed paper so that the trailing end thereof is positioned at a determined position, without being influenced either by environmental changes in temperature and the like at the installation site or by variation in the voltage supplied to the motor of the paper money feeding means.

DISCLOSURE OF THE INVENTION

According to the present invention, a paper sheet feeder comprises paper conveying means having a motor, for conveying paper along a paper feeding route; a paper detection sensor provided in the paper feeding route; and control means for stopping drive of the motor after the paper has passed the paper detection sensor and positioning the paper at a prescribed position downstream of the paper detection sensor, wherein the control means are made so as to control drive time of the motor after the paper has passed the paper detection sensor, based on time interval required for the paper to pass through a certain sector of the paper feeding route positioned upstream from the paper detection sensor.

BEST MODE FOR CARRYING OUT THE INVENTION

A detailed description is given below of a paper money feeder for processing the conveyance of paper money that is one example of papers, as one embodiment of the paper sheet feeder according to the present invention.

Figure 1:
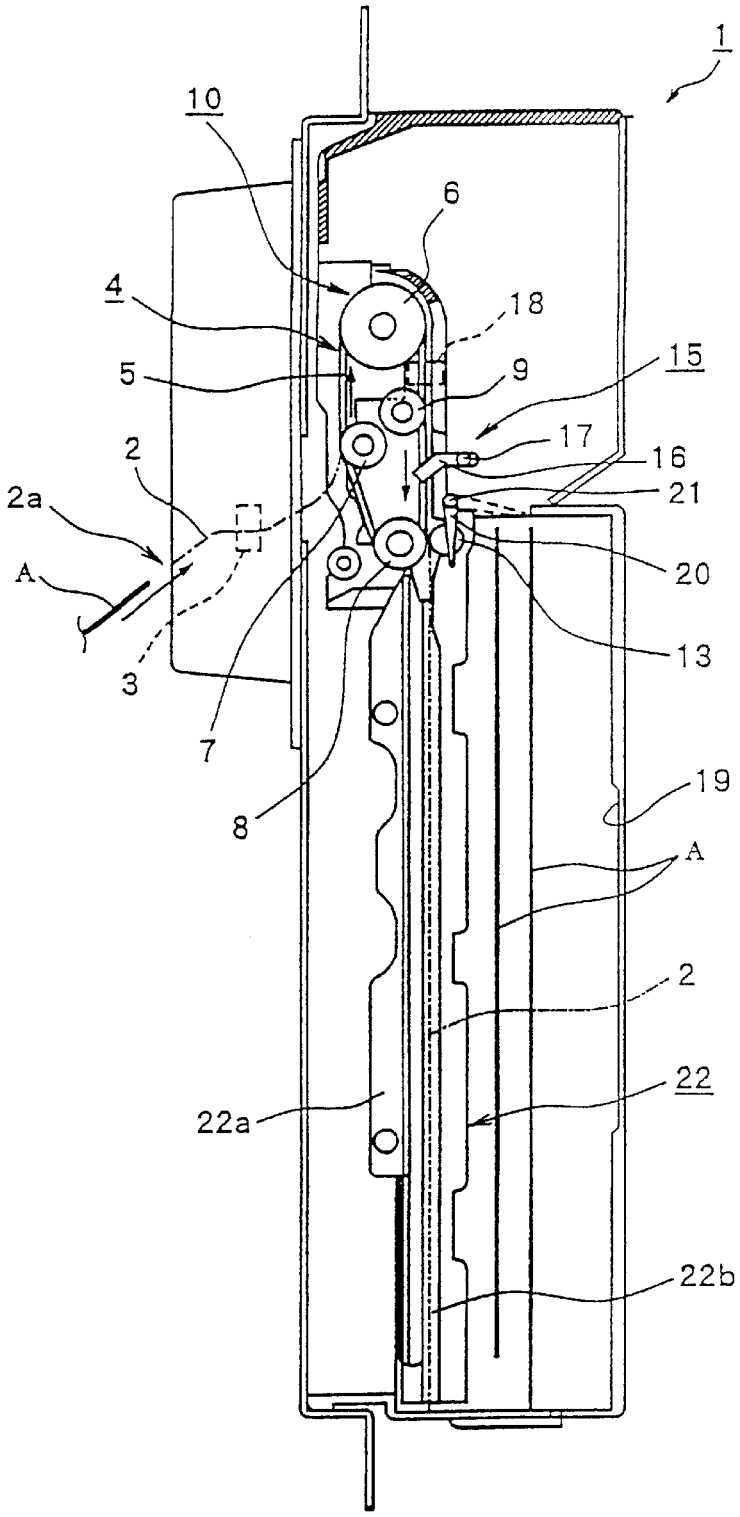
FIG. 1 is a schematic cross-sectional view of the main parts of one embodiment of a paper money feeder according to the present invention.
Figure 8:
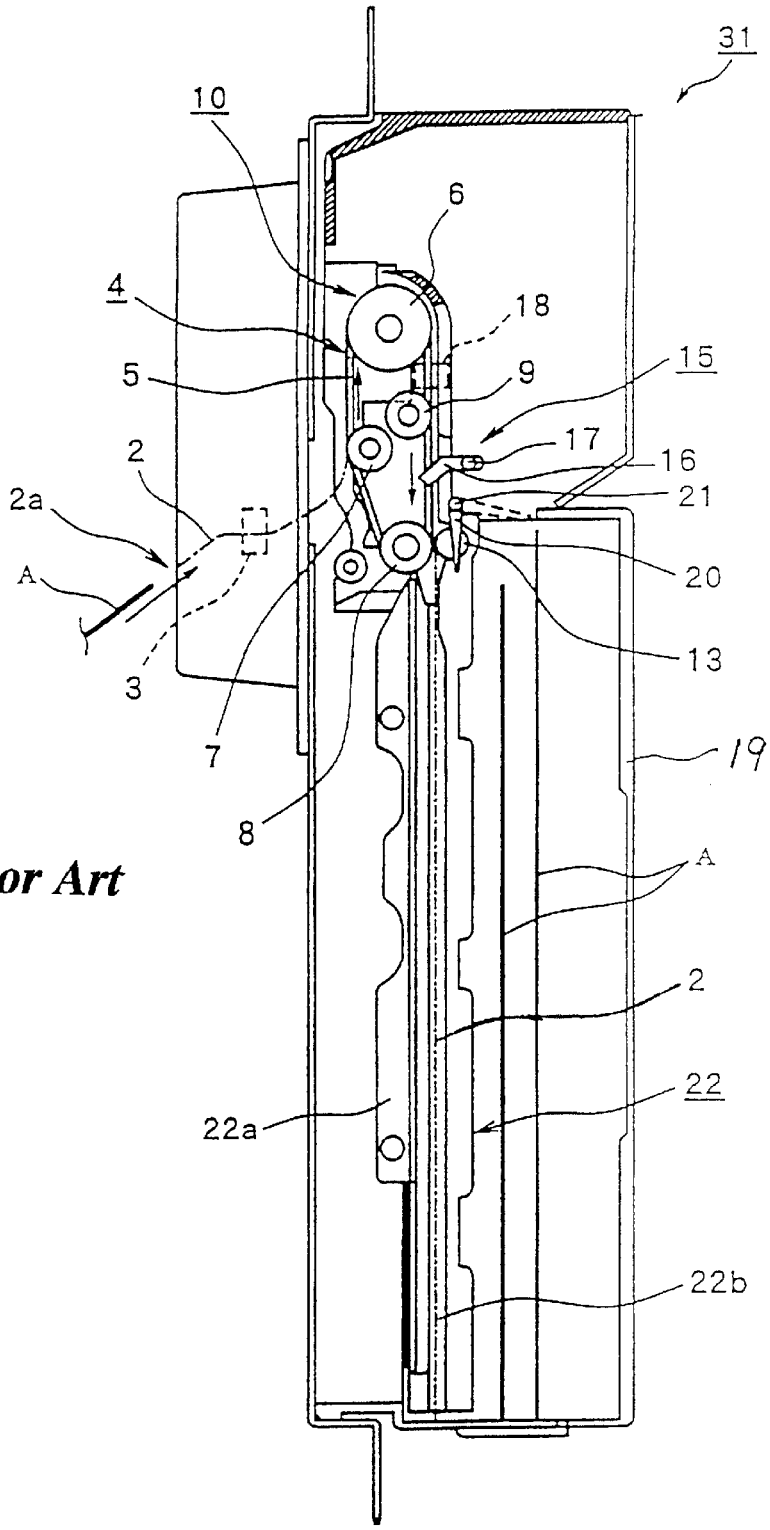
Prior Art FIG.8
FIG. 8 is a schematic cross-sectional view of the main parts of a conventional paper money feeder.
Figure 9:
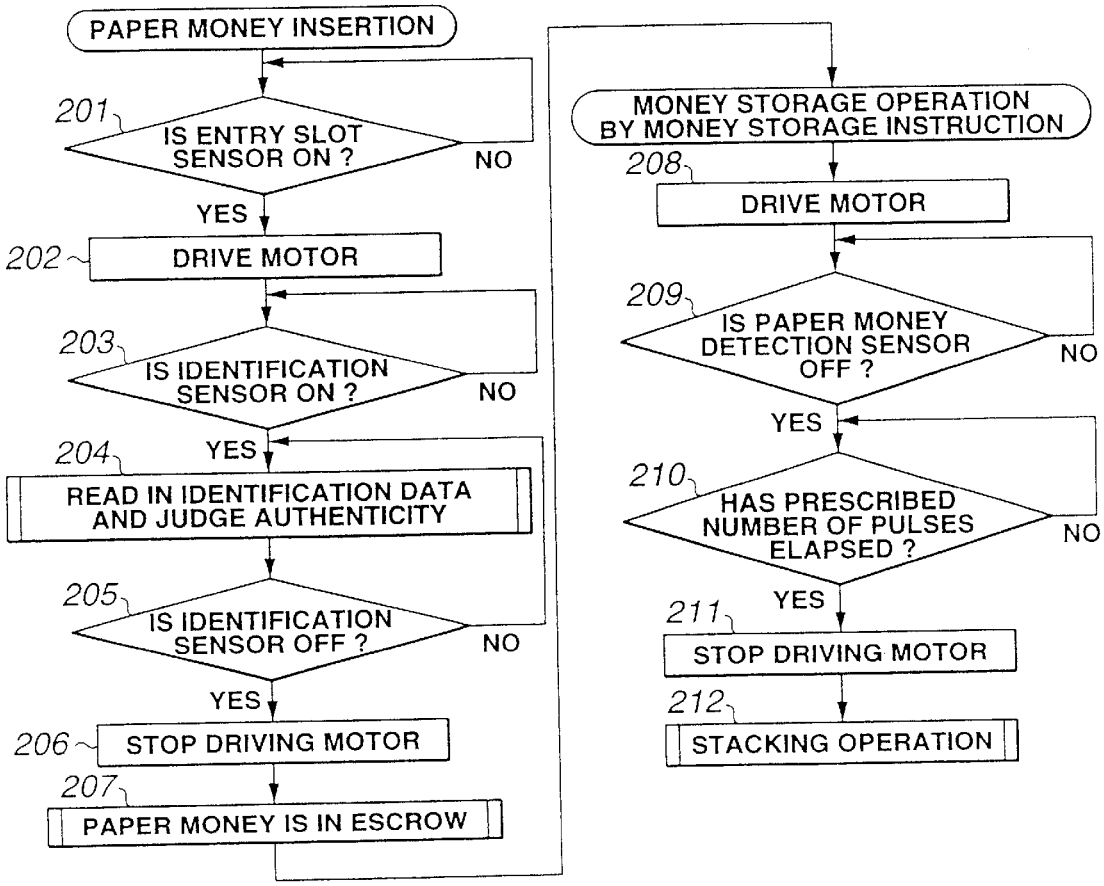
FIG. 9 is a flowchart of the processing procedures of control means for controlling the conventional paper sheet feeder illustrated in FIG. 8.

FIG. 1 is a schematic cross-sectional view of the main parts of a paper money feeder wherein the paper sheet feeder of the present invention has been applied, wherein parts that are the same as in FIG. 8 are designated by the same symbols.

This paper money feeder 1 comprises paper money feeding means 4 comprising a motor 11 (FIG. 2) for conveying paper money A inserted through the paper money insertion slot 2*a* along the roughly inverted U-shaped paper money feeding route 2, the paper money detection sensor 15 placed in the paper money feeding route 2, and control means 25 (FIG. 2) for stopping the drive of the motor 11 after the paper money A passes the paper money detection sensor 15 and positioning the paper money in a prescribed position downstream of the paper money detection sensor 15.

Of those components, the paper money feeding means 4 are configured of the endless paper money conveyance belt 5, the paper money conveyance belt drive means 10, the motor 11 (FIG. 2) for imparting a drive force to the paper money conveyance belt drive means 10, and the encoder 12 (FIG. 2) for detecting the drive pulse number for that motor 11.

In the paper money feeding route 2, furthermore, as in the conventional example, are provided the entry slot sensor 3, paper money identification sensor 18 comprising photosensors, stacker 19, paper return prevention lever 20, and paper money moving means 22 comprising the pressing part 22*a*.

Next, the operation of the paper money feeder 1 described above is described, and, in conjunction therewith, the configuration thereof is described in greater detail.

Figure 2:
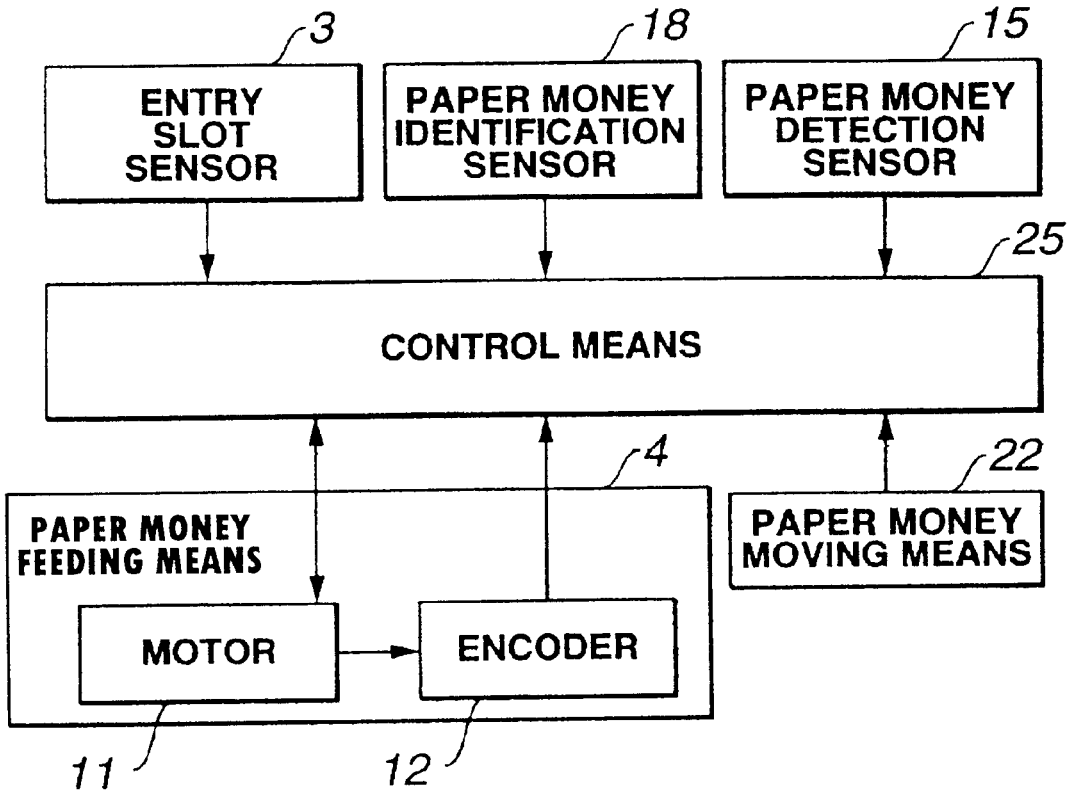
FIG. 2 is a block diagram of control means for controlling the paper money feeder illustrated in FIG. 1.

FIG. 2 is a block diagram of the control means 25 for controlling the drive of the paper money feeder 1 of the present invention.

These control means 25 are configured of a CPU (central processing unit) and peripheral circuits the main configuring elements whereof are a main memory unit and an auxiliary memory unit.

To these control means 25, paper money A insertion information is input from the entry slot sensor 3, and paper money A travel position information and paper money A genuine/counterfeit identification information are input from the paper money identification sensor 18. To the control means 25, furthermore, paper money A travel position information is input from the paper money detection sensor 15, and information relating to the drive pulse number for the motor 11 of the paper money feeding means 4 is input from the encoder 12 in the paper money feeding means 4. To the control means 25, in addition, vending machine transaction processing information is input.

Furthermore, the control means 25 judge whether the paper money is genuine or counterfeit, based on the input paper money A genuine/counterfeit identification information, and also control the drive of the motor 11 of the paper money feeding means 4 based on the results of that judgment and on various other information.

In addition, the control means 25 measure the time interval T1 required for the paper money A to pass through a certain sector of the paper money feeding route 2 positioned upstream from the paper money detection sensor 15, then, based on that time interval T1, calculate the time to drive the motor 11 after the paper money A passes the paper money detection sensor 15 (that is, calculate correction pulse number P), and, based on the results of that calculation, control the drive of the motor 11 and the drive of the paper money moving means 22.

Figure 3:
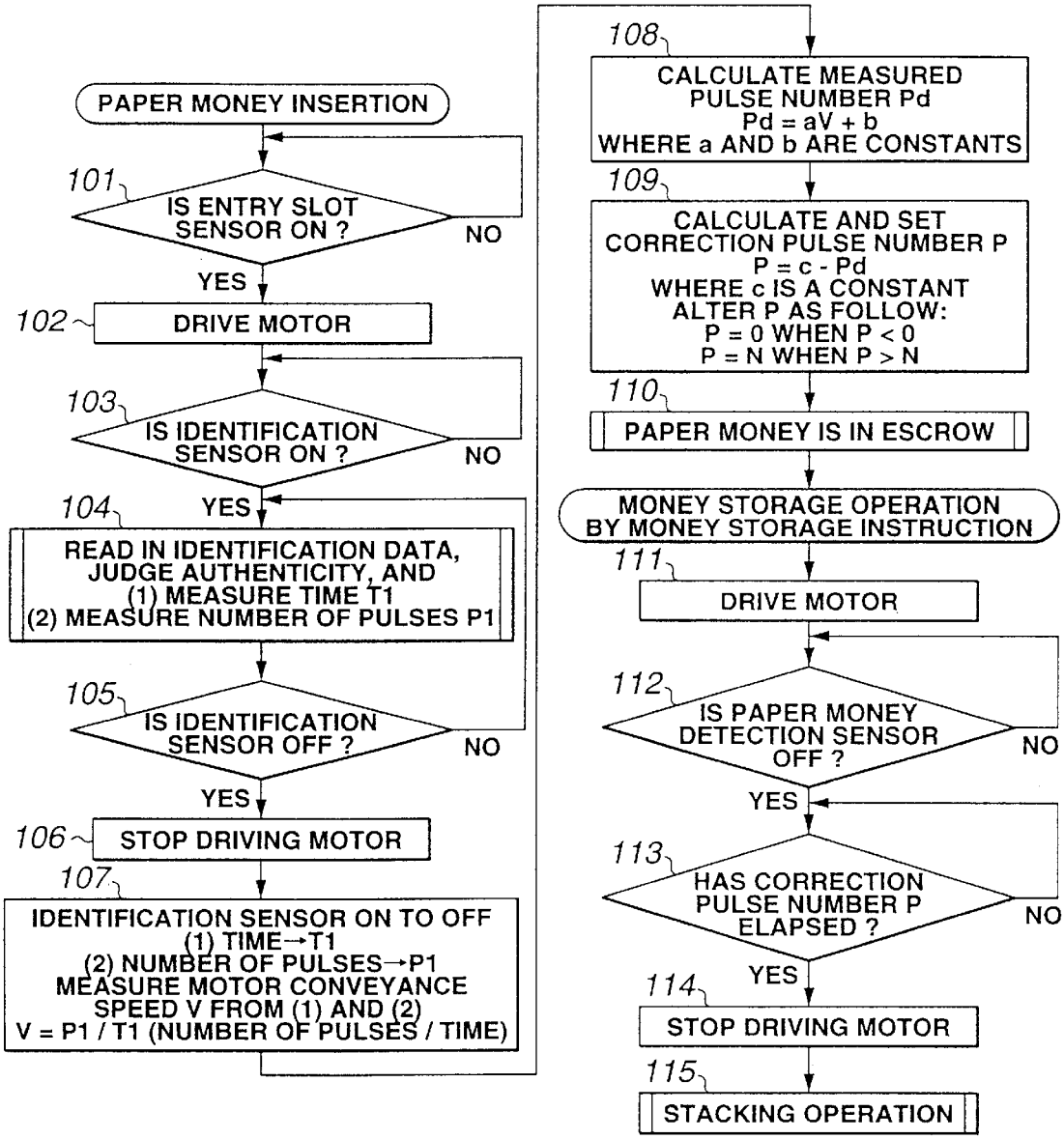
FIG. 3 is a flowchart of the processing procedures of control means for controlling the paper money feeder illustrated in FIG. 1.

Next, the processing procedures of the control means 25 described above are described with the flowchart given in FIG. 3, and FIGS. 4(*a*) and 4(*b*) (described below).

In the standby condition, the control means 25 judge whether or not the entry slot sensor 3 has turned ON (step 101) and then, when the entry slot sensor 3 does turn ON, judge that paper money A has been inserted through the paper money insertion slot 2*a* and that the leading end of that paper money A has passed the entry slot sensor 3, and drive the motor 11 of the paper money feeding means 4 (step 102). Thereupon, the pulleys 6, 7, 8, and 9 of the paper money conveyance belt drive means 10 turn in the clockwise direction and the paper money conveyance belt 5 also turns in the clockwise direction. As a consequence, due to the driving force of the paper money conveyance belt 5, the paper money A is conveyed upward along the paper money feeding route 2. When the leading end of the paper money A passes the pulley 6, that paper money is conveyed downward along the paper money feeding route 2.

The control means 25, meanwhile, after driving the motor 11 of the paper money feeding means 4 in step 102, judge whether or not the paper money identification sensor 18 has turned ON (step 103) and, upon judging that that paper money identification sensor 18 has turned ON, judge that the leading end of the paper money A has reached the paper money identification sensor 18, perform processing to read in identification information for that paper money A by the paper money identification sensor 18 (step 104), and judge whether the paper money A is genuine or counterfeit.

The control means 25 begin to measure the time interval T1 required for the paper money A to pass through the certain sector in the paper money feeding route 2 positioned upstream from the paper money detection sensor 15, and, at the same time, begin to measure, by the encoder 12, the number of pulses P1 that the motor 11 has been driven within that time interval T1.

In the condition wherein the leading end of the paper money A has reached the paper money identification sensor 18 (step 104), the motor 11 has already reached a constant speed state.

Meanwhile, when the control means have judged the paper money A to be genuine, those control means convey the paper money A further downstream in the paper money feeding route 2, maintaining the forward drive of the motor 11 in the paper money feeding means 4, and also judge whether or not the paper money identification sensor 18 has turned OFF (step 105).

Upon judging that the paper money identification sensor 18 has turned OFF in step 105, the control means 25 judge that the trailing end of the paper money A has passed the paper money identification sensor 18, stop the motor 11 in the paper money feeding means 4 (step 106), and terminate both the measurement of the time interval T1 required for the paper money A to pass through the certain sector and the measurement of the number of pulses P1 the motor 1 was driven within that time interval T1.

Based on the measured drive time interval T1 and the number of pulses P1 for the motor 11, the control means 25 calculate (in step 107) the motor conveyance speed V by the following formula.

Calculation Formula 1:

$$V=P1/T1 \text{(number of pulses/time)}$$

Next, based on the conveyance speed V of the motor 11 so calculated, the control means 25 calculate (in step 108) the number of pulses Pd that the motor 11 is driven by inertial force when that motor 11, being driven at that conveyance speed V, was immediately stopped at the point in time when the trailing end of the paper money A passed the paper money detection sensor 15 (hereinafter called the "measured pulse number Pd") by the following formula.

Calculation Formula 2:

$$Pd=aV+b$$

(where a and b are constants)

The constants a and b are constants obtained by prior experimental investigation of the relationship between the conveyance speed V of the motor 11 and the number of pulses Pd that motor 11 is driven by inertial force when that motor 11, being driven at the conveyance speed V, is stopped immediately at the point in time when the trailing end of the paper money A passes the paper money detection sensor 15. That is, it has been demonstrated that, within the range of the conveyance speed V of the motor 11 when performing paper money conveyance operations or paper money positioning operations, whether at low temperature, normal temperature, or high temperature, the relational equation Pd=aV+b (where a and b are constants) is roughly established.

Next, based on the measured pulse number Pd calculated according to Calculation Formula 2, the control means 25 (in step 109) calculate the correction pulse number P according to the following formula.

Calculation Formula 3:

$$P=c-Pd$$

(where c is a constant)

The constant c is the drive pulse number required for the motor 11 to convey the paper money A the trailing end whereof has passed the paper money detection sensor 15, over the distance between the paper money detection sensor 15 and the paper money return prevention lever 20, that is, the ideal pulse number calculated beforehand as the drive pulse number the motor 11 should be driven so as to turn after the paper money A trailing end has passed the paper money detection sensor 15.

In this Calculation Formula 3, the correction pulse number P calculated as the difference between the constant c that is the ideal pulse number and the measured pulse number Pd is a value that indicates, with reference to the drive pulse number for the motor 11, the extent to which the paper money A is not fed far enough, or the extent to which it is fed too far, by the turning resulting only from the inertial force of the motor 11 when the drive of the motor 11 is stopped immediately after the trailing end of the paper money A has passed the paper money detection sensor 15.

With this paper money feeder 1, furthermore, as will be described subsequently, the motor 11 is not stopped immediately at the point in time when the trailing end of the paper money A passes the paper money detection sensor 15, but provision is made so that it is stopped after driving it just the correction pulse number P. Hence correction is effected so that the drive pulse number wherewith the motor 11 is driven after the paper money A has passed the paper money detection sensor 15 becomes the ideal pulse number c in overall terms inclusive of the inertial force.

Figures 4A, 4B:
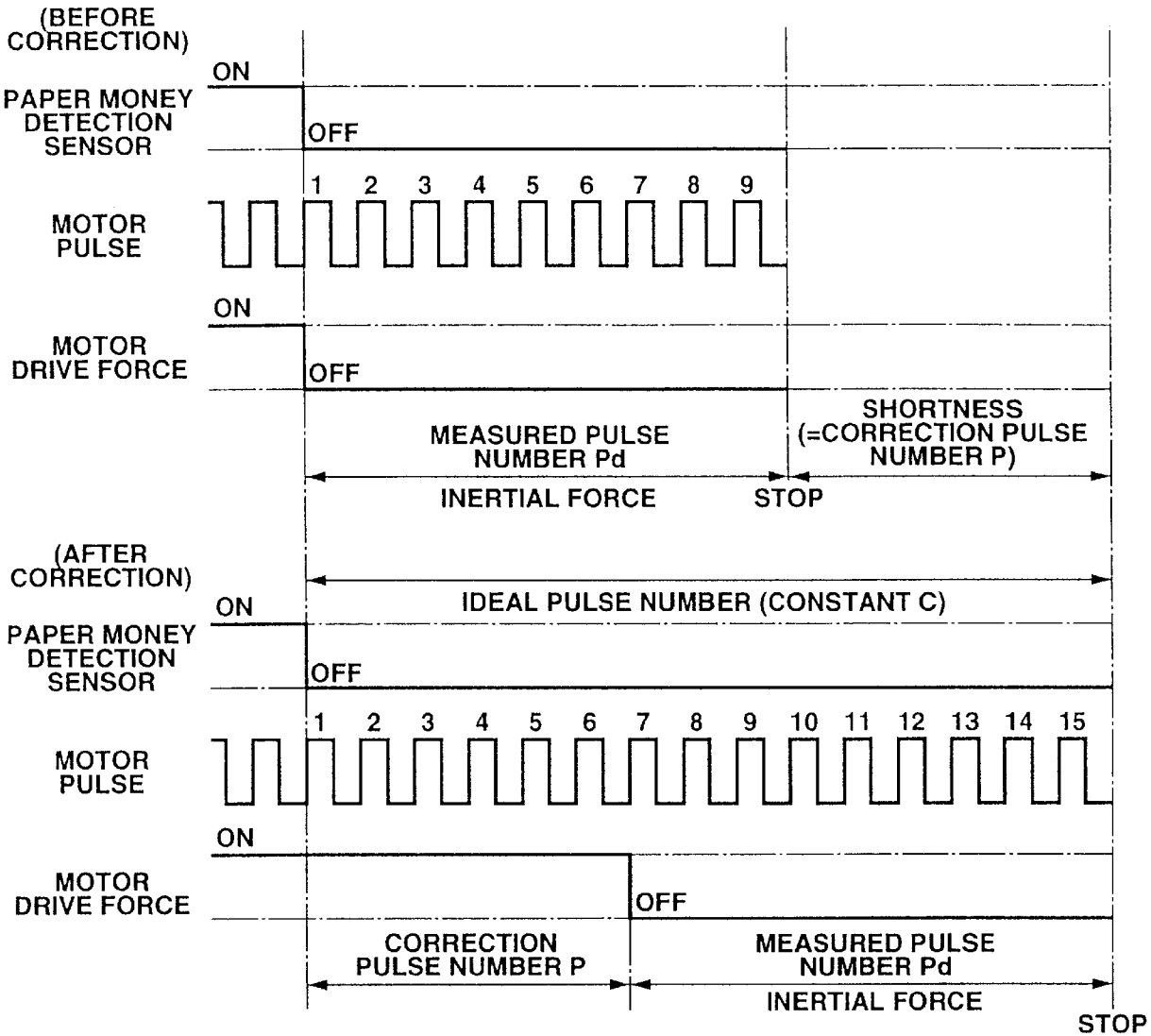
FIGS. 4(*a*) and 4(*b*) are diagrams representing the relationship between the motor drive time after the trailing end of paper money has been detected by a paper money detection sensor and the distance the paper money is conveyed by the motor (horizontal axis), with FIG. 4(*a*) particularly representing the situation prior to correcting the motor drive time after detection of the trailing end of the paper money by the paper money detection sensor, and FIG. 4(*b*) representing the situation after correcting the motor drive time after detection of the trailing end of the paper money by the paper money detection sensor.

If the measured number of pulses Pd is fewer than the ideal pulse number c (P>0), for example, as illustrated in FIG. 4(*a*), when the motor 11 is stopped immediately at the point in time when the trailing end of the paper money A passed the paper money detection sensor 15, the paper money A will not be conveyed all the way to the determined position but will be insufficiently fed, but the distance of that feed shortness can be detected beforehand in terms of how many pulses it is, with reference to the drive pulse number for the motor 11, by the correction pulse number P.

In that case, then, the motor 11 is not stopped immediately at the point in time when the paper money A passes the paper money detection sensor 15, but provision is made so that, as illustrated in FIG. 4(*b*), the motor 11 is stopped after an allowance for the lacking pulses, that is, after being driven by just the correction pulse number P. When that is done, the drive pulse number wherewith the motor 11 is driven after the paper money A passes the paper money detection sensor 15 can be corrected to the ideal pulse number c in overall terms inclusive of the inertial force, and thus the trailing end of the paper money A can be stopped at the determined position.

FIGS. 4(*a*) and 4(*b*) are diagrams representing the relationship between the drive time for the motor 11 after the trailing end of the paper money A is detected by the paper money detection sensor 15 and the distance the paper money A trailing end is conveyed by the motor 11 (horizontal axis). FIG. 4(*a*) represents a situation where, when the motor 11 is stopped immediately at the point in time when the trailing end of the paper money A is detected by the paper money detection sensor 15, the motor 11 is driven by just the measured pulse number Pd by the inertial force and then stopped. That measured pulse number Pd here is fewer than the ideal pulse number c, wherefore the trailing end of the paper money A is stopped after being fed insufficiently.

FIG. 4(*b*) represents a situation where, by stopping the motor 11 resulting in feed insufficiency by the inertial force alone after driving it by just the correction pulse number P after the trailing end of the paper money A is detected by the paper money detection sensor 15, the drive pulse number for the motor 11 after the detection of the trailing end of the paper money A is corrected so that it becomes the ideal pulse number c, and the trailing end of the paper money A is stopped and positioned to the degree possible at the determined position.

In FIGS. 4(*a*) and 4(*b*), in particular, situations are represented where the measured pulse number Pd is 9 pulses, the correction pulse number P is 6 pulses, and the ideal pulse number is 15 pulses.

However, when the correction pulse number P found from the Calculation Formula 2 described earlier is such that P>N, the control means alter the correction pulse number P so that P=N. This value N is the upper limit on the paper money feed amount at which the trailing end of the paper money A does not fall away from the paper money return prevention lever 20, in a relationship such that c<N.

Thus when the correction pulse number P is such that P>N, that indicates that the measured number of pulses Pd found from the conveyance speed V is far fewer than the ideal pulse number c, and that the amount of paper money A feed insufficiency is extremely large. However, when the distance between the paper money detection sensor 15 and the paper money return prevention lever 20 is taken into consideration, it is believed that, in actuality, the trailing end of the paper money A will be engaged by the paper money return prevention lever 20 (described subsequently) if the correction pulse number P is such that P=N, wherefore the correction pulse number P is corrected so that P=N. That is, when the calculated correction pulse number P is such that P>N, by stopping the motor 11 after driving it by just the number of pulses N after the paper money A passes the paper money detection sensor 15, the trailing end of the paper money A is stopped and positioned to the degree possible at the determined position.

When P<0, on the other hand, the control means 25 alter the correction pulse number P so that P=0.

Thus, a case where P<0 indicates that the measured number of pulses Pd found from the conveyance speed V is greater than the ideal pulse number c, in which case, even if the motor 11 is stopped immediately after the trailing end of the paper money A passes the paper money detection sensor 15, the paper money A will be sent further downstream than the determined position, resulting in the paper money A being fed too far, but the distance of that overfeeding can be detected beforehand in terms of how many pulses it is, with reference to the drive pulse number for the motor 11, by the correction pulse number P.

In this case, furthermore, the motor 11 should be stopped at a position where the motor 11 has been driven number of pulses that is fewer by the number of pulses of overfeeding, before the paper money A passes the paper money detection sensor 15, but the control means 25 are such that they will stop the drive of the motor 11 after the paper money A has passed the paper money detection sensor 15, wherefore control cannot be effected to make P<0, and, for that reason, the correction pulse number P is here altered so that P=0. That is, provision is made so that, when P<0, the drive of the motor 11 is stopped immediately at the point in time when the paper money A passes the paper money detection sensor 15, and the trailing end of the paper money A is thereby stopped and positioned to the degree possible at the determined position.

In step 106, meanwhile, the control means 25 have stopped the drive of the motor 11 in the paper money feeding means 4, wherefore the paper money feeder 1 has transitioned to the so-called paper money escrow condition where it temporarily holds the paper money A in the paper money feeding route 2 (step 110). In this paper money escrow condition, the leading end of the paper money A has already passed the paper money detection sensor 15, and that paper money detection sensor 15 is turned ON.

While in this paper money escrow condition, if a product purchase button on the vending machine is pressed, the control means 25 will judge that a normal transaction has been performed, discharge a product from the vending machine, and transition to a money storage operation for taking the paper money A that is being temporarily held (escrowed) in the paper money feeding route 2 and accommodating it in the stacker 19.

That is, when the money storage operation is transitioned to, the control means 25 again drive the motor 11 of the paper money feeding means 4 in the forward direction (step 111), causing the paper money conveyance belt 5 to turn in the forward direction, thus guiding the paper money A further downstream, and begin to determine whether or not the paper money detection sensor 15 has turned OFF (step 112). In this step 112, upon determining that the paper money detection sensor 15 has turned OFF, the control means 25 judge that the trailing end of the paper money A has passed the paper money detection sensor 15, and stop the motor 11 (in step 114), after driving it just the correction pulse number P calculated as noted earlier (in step 113), from the input of the OFF signal by the output from the paper money detection sensor 15.

Thus, in this paper money feeder 1, the control means 25 are made so that, based on the time interval T1 required for paper money A to pass through a certain sector in the paper money feeding route 2 positioned upstream from the paper money detection sensor 15, those means calculate beforehand the conveyance speed V of the motor 11 at the point in time when the trailing end of the paper money A will pass the paper money detection sensor 15, then, from that measured pulse number Pd, based on that conveyance speed V, calculate beforehand the measured pulse number Pd wherewith the motor 11 will be driven by inertial force when it is stopped immediately at the point in time when the paper money A passes the paper money detection sensor 15, then calculate, as the correction pulse number P, the time the motor 11 is driven until that motor 11 is stopped after the paper money A trailing end passes the paper money detection sensor 15, so that the drive pulse number wherewith the motor 11 is driven after the paper money A passes the paper money detection sensor 15 becomes the ideal pulse number c, in overall terms, and control the motor 11 based on that correction pulse number P. Therefore, those control means 25 can stop the trailing end of the paper money A to the degree possible at the determined position, irrespective of fluctuations in the inertial force after the motor 11 drive stops, even when the load on that motor 11 fluctuates and the paper money A conveyance speed V has fluctuated due to environmental changes in temperature and the like at the installation site for the vending machine or the like comprising that paper money feeder 1, or fluctuations in the voltage supplied to the motor of the paper money feeding means 4.

In a case, for example, where a vending machine comprising the paper money feeder 1 has been installed at a low-temperature site, or the voltage supplied to the motor of the paper money feeding means 4 is low voltage (LV), the load on that motor becomes large compared to cases of normal temperature, and the speed V wherewith the paper money A is conveyed becomes slower, as a consequence whereof there is a danger that the inertial force after the motor 11 stops will become small and that feed insufficiency will ensue wherewith the trailing end of the paper money A is not fed all the way to the determined position. With this paper money feeder 1, however, the conveyance speed V of that motor 11 is detected beforehand based on the time interval T1 required for the paper money A to pass through a certain sector upstream from the paper money detection sensor 15. Then, based on that detected conveyance speed V of the motor 11, the measured pulse number Pd wherewith the motor 11 will be driven by the inertial force when the motor 11 is stopped immediately at the point in time when the paper money A passes the paper money detection sensor 15 is calculated beforehand. Then, based on that measured pulse number Pd, by how much the motor 11 will feed insufficiently is detected in terms of the correction pulse number P. Therefore, when provision is made to stop the motor 11 after it has been further driven, by the correction pulse number P, from the point in time when that paper money A passed the paper money detection sensor 15, the drive pulse number from the point in time when the paper money A passes the paper money detection sensor 15 until the motor stops can be made the ideal pulse number P, in overall terms inclusive of the inertial force. Therefore, the danger of the paper money A not being fed far enough with the inertial force of the motor 11 being small can be avoided to the degree possible, and, as a consequence, the trailing end of the paper money A stopped and positioned to the degree possible at the determined position.

In a case, on the other hand, where a vending machine comprising the paper money feeder 1 has been installed at a high-temperature site, or the voltage supplied to the motor of the paper money feeding means 4 is high voltage (HV), the load on that motor becomes smaller than in cases of normal temperature, and the speed V wherewith the paper money A is conveyed becomes faster, as a consequence whereof the inertial force after the motor 11 stops will become larger. However, the conveyance speed V of that motor 11 is detected beforehand based on the time interval T1 required for the paper money A to pass through a certain sector upstream from the paper money detection sensor 15. Then, based on that conveyance speed V, the measured pulse number Pd wherewith the motor 11 will be driven by the inertial force when it is stopped immediately at the point in time when the paper money A passes the paper money detection sensor 15 is calculated beforehand. And, based on that measured pulse number Pd, the overfeeding of the paper money A by the motor 11 can be detected in terms of the correction pulse number P. In this case, therefore, provision is made so that the drive of the motor 11 is immediately stopped when that paper money A passes the paper money detection sensor 15 (altering the correction pulse number P when $P<0$ so that $P=0$), and provision is made so that, thereby, the drive pulse number whereby the motor 11 is driven after the paper money A passes the paper money detection sensor 15 is made to approach as close as possible to the ideal pulse number P. For that reason, the danger of the trailing end of the paper money A being fed too far, downstream from the determined position, with the inertial force of the motor 11 being large, can be avoided to the degree possible, and, as a consequence, the trailing end of the paper money A can be stopped and positioned to the degree possible at the determined position.

Accordingly, after step 114, when the control means 25 drive the pressing part of the paper money moving means 22, the paper money is guided piece by piece toward the stacker 19 (step 115), and the paper money A is definitely accommodated inside the stacker 19 and engaged definitely by the paper money return prevention lever 20. As a consequence, the danger of the paper money A failing to be engaged by the paper money return prevention lever 20 so that it interferes with paper money A accommodation operations or causes paper money jamming will be eliminated to the extent possible.

Provision is made in this embodiment so that the time the motor 11 is driven after the paper money A passes the paper money detection sensor 15 (correction pulse number P) is calculated and, based on the results of that calculation, the drive of the motor 11 and the drive of the paper money moving means 22 are controlled. However, the present invention is not limited to or by the embodiment described in the foregoing, but provision may be made instead so that, without using a paper money detection sensor 15, the drive time during which the motor 11 is again driven after the trailing end of the paper money A has passed the paper money identification sensor 18 and stopped (the correction pulse number P') is calculated and, based on the results of that calculation, the drive of the motor 11 that is again driven and the drive of the paper money moving means 22 are controlled.

Figure 5:
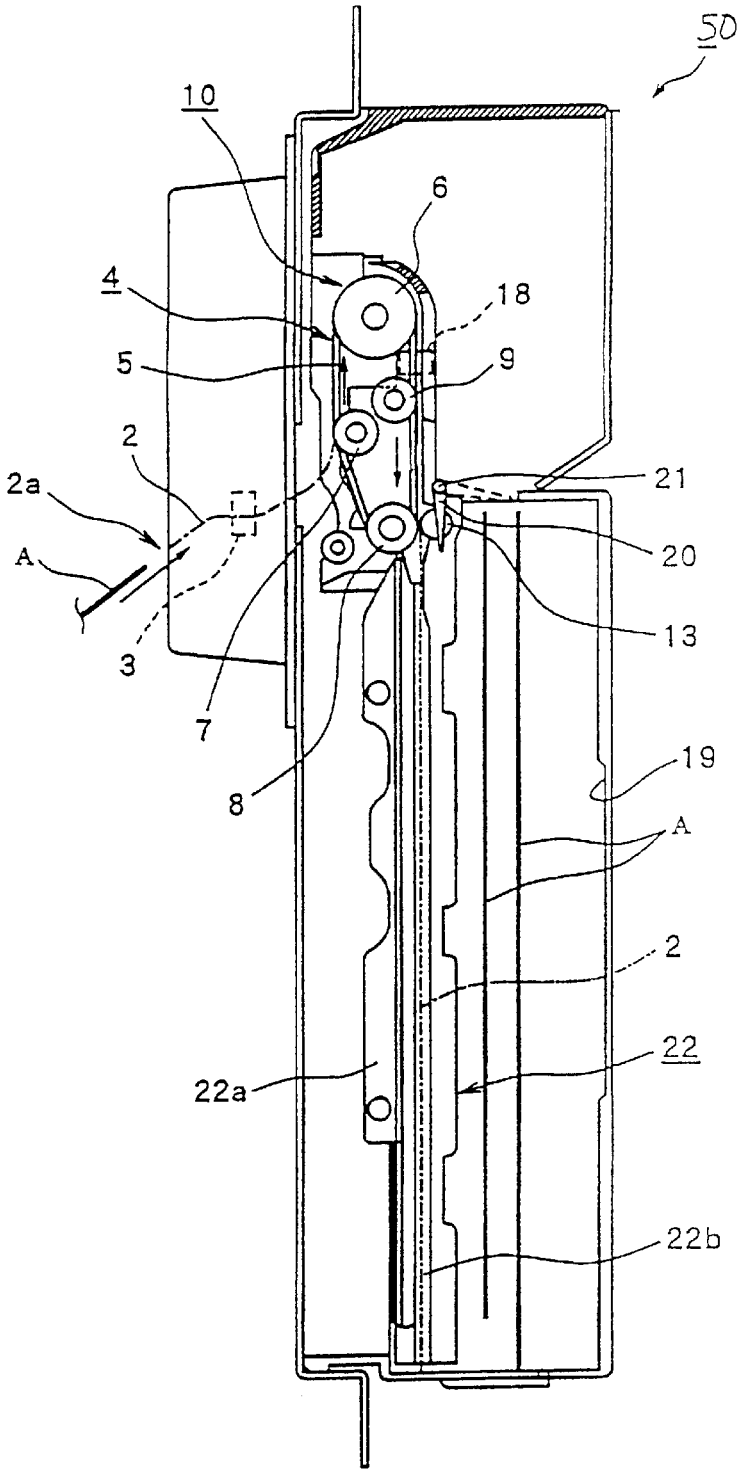
FIG. 5 is a schematic cross-sectional view of the main parts of another embodiment of the paper money feeder.

FIG. 5 is a schematic cross-sectional view of the main parts of a paper money feeder 50 representing another embodiment of the present invention, wherein the same parts as in FIG. 1 are designated by the same symbols.

This paper money feeder 50 differs from the paper money feeder 1 described earlier only insofar as no use is made of the paper money detection sensor 15 or the processing procedures performed by the control means 25 described earlier. Otherwise the configuration is the same and the same parts are not described further here. Needless to say, the paper money detection sensor 15 block is removed from the block diagram in FIG. 2.

Next, the processing procedures performed by the control means 25 of the paper money feeder 50 described above are described with the flowchart given in FIG. 6, and FIGS. 7(*a*) and 7(*b*) (described subsequently).

With this paper money feeder 50 also, as with the paper money feeder 1 described earlier, when in the standby condition, the control means 25 judge whether or not the entry slot sensor 3 has turned ON (step 101) and then, when the entry slot sensor 3 does turn ON, judge that paper money A has been inserted through the paper money insertion slot 2*a* and that the leading end thereof has passed the entry slot sensor 3, and drive the motor 11 of the paper money feeding means 4 (step 102). Thereupon, the pulleys 6, 7, 8, and 9 of the paper money conveyance belt drive means 10 turn in the clockwise direction and the paper money conveyance belt 5 also turns in the clockwise direction. As a consequence, due to the driving force of the paper money conveyance belt 5, the paper money A is conveyed upward along the paper money feeding route 2 and, when the leading end of the paper money A passes the pulley 6, that paper money is conveyed downward along the paper money feeding route 2.

The control means 25, meanwhile, after driving the motor 11 of the paper money feeding means 4 in step 102, judge whether or not the paper money identification sensor 18 has turned ON (step 103) and, upon judging that that paper money identification sensor 18 has turned ON, judge that the leading end of the paper money A has reached the paper money identification sensor 18, perform processing to read in identification information for that paper money A by the paper money identification sensor 18 (step 104), and judge whether the paper money A is genuine or counterfeit.

The control means 25, in step 104, begin to measure the time interval T1 required for the paper money A to pass through the certain sector in the paper money feeding route 2 positioned upstream from the paper money identification sensor 18, and, at the same time, begin to measure, by the encoder 12, the number of pulses P1 that the motor 11 has been driven within that time interval T1.

In the condition wherein the leading end of the paper money A has reached the paper money identification sensor 18 (step 104), the motor 11 has already reached a constant speed state.

Meanwhile, when the control means 25 have judged the paper money A to be genuine, in step 104, those control means convey the paper money A further downstream in the paper money feeding route 2, maintaining the forward drive of the motor 11 in the paper money feeding means 4, and also judge whether or not the paper money identification sensor 18 has turned OFF (step 105).

Upon judging that the paper money identification sensor 18 has turned OFF in step 105, the control means 25, in step 106, judge that the trailing end of the paper money A has passed the paper money identification sensor 18, and stop the motor 11 in the paper money feeding means 4. Thus the control means 25 cause the paper money A to reach a state of temporary holding (escrowed condition) and, at the same time, measure the time interval T1 required for the paper money A to pass through the certain sector noted earlier and terminate the measurement of the number of pulses P1 the motor 11 was driven within that time interval T1.

Next, after stopping the drive of the motor 11 by the paper money feeding means 4 in step 106, the control means 25 measure, by the encoder 12, the number of pulses until the motor 11 actually stops turning, that is, the motor stop pulse number Pst, and stores that motor stop pulse number Pst in memory (step 107).

Next, the control means 25 (in step 108) calculate the motor conveyance speed V, based on the drive time interval T1 measured in step 106 and the number of pulses P1 for the motor 11, from the formula below.

Calculation Formula 1:

$$V=P1/T1 \text{(number of pulses/time)}$$

Next, based on the conveyance speed V of the motor 11 calculated, the control means 25 (in step 109) calculate the number of pulses Pd wherewith that motor 11 is driven by inertial force when the drive of the motor 11 being driven at that conveyance speed V is immediately stopped (hereinafter called the "measured pulse number Pd") as described earlier from the following formula.

Calculation Formula 2:

$$Pd=aV+b$$

(where a and b are constants)

Next, based on the measured pulse number Pd calculated by Calculation Formula 2, the control means 25 (in step 110) calculate the correction pulse number P' from the following formula.

Calculation Formula 3:

$$P'=c'-Pd-Pst$$

(where c' is a constant)

The constant c' here is the ideal pulse number obtained by calculating beforehand the drive pulse number for the motor 11 required when the paper money A is conveyed over the distance between the paper money identification sensor 18 and the paper money return prevention lever 20, that is, the drive pulse number the motor 11 should be driven so that it turns after the paper money A trailing end passes the paper money identification sensor 18.

In this Calculation Formula 3, the correction pulse number P' calculated by subtracting the measured pulse number Pd and the motor stop pulse number Pst from the constant c' that is the ideal pulse number is a value that expresses, with reference to the drive pulse number for the motor 11, either by how far the paper money A will be insufficiently fed, or how far it will be overfed, when the motor 11 is again driven and immediately stopped, after the trailing end of the paper money A has passed the paper money identification sensor 18 and stopped in the escrow position (Pst), and the paper money A is conveyed beyond that by the inertial force of the motor 11. With this paper money feeder 50, as will be described further below, after the trailing end of the paper money A passes the paper money identification sensor 18 and is stopped in the escrow position, the motor 11 is not driven again and immediately stopped, but provision is made so that the motor 11 is stopped after being driven by just the correction pulse number P' described above, whereby, after the paper money A passes the paper money identification sensor 18 and has stopped in the escrow position, the drive pulse number by which the motor 11 is again driven is corrected so that it becomes the ideal pulse number c', in overall terms inclusive of the inertial force.

Figures 7A, 7B:
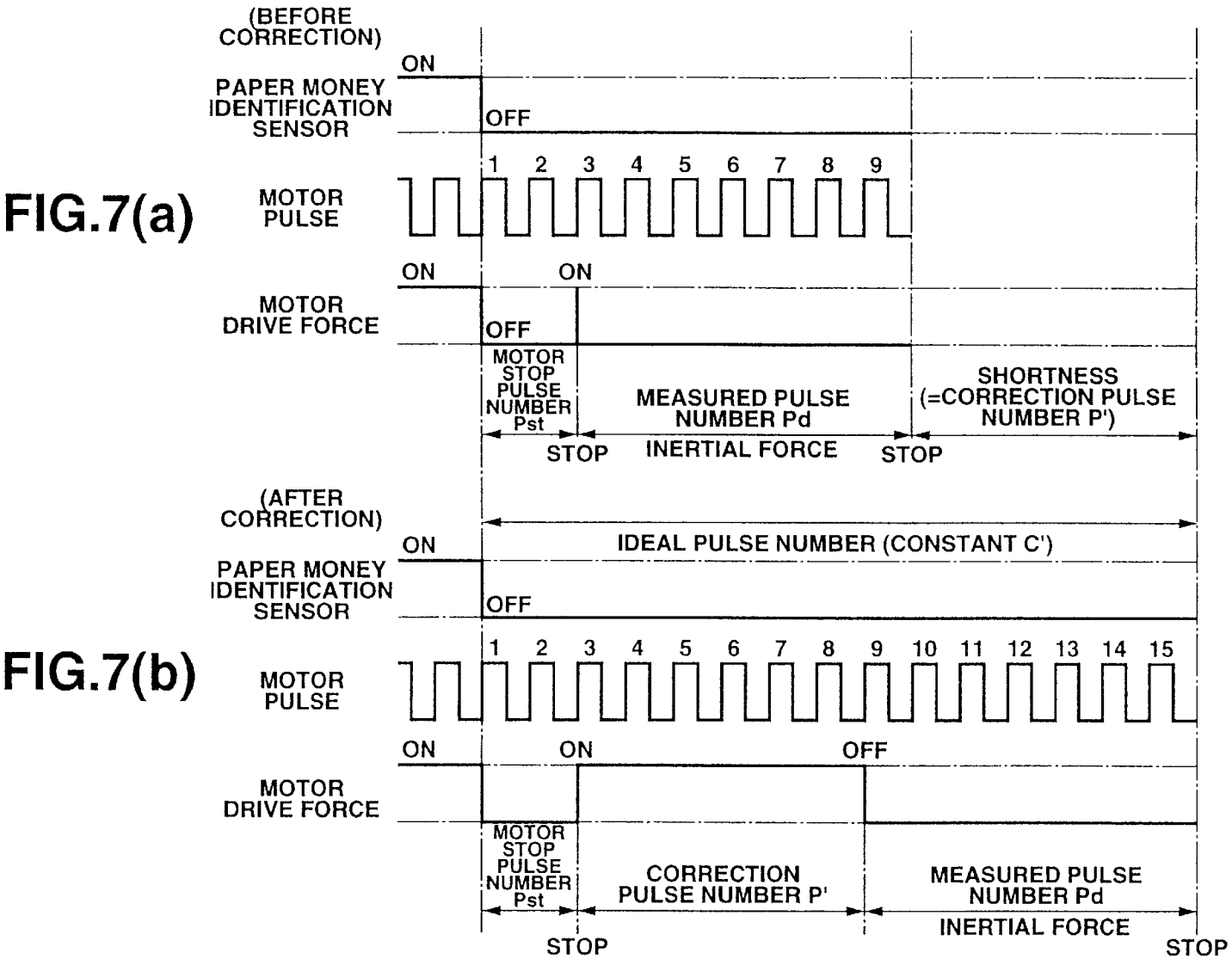
FIGS. 7(*a*) and 7(*b*) are diagrams representing the relationship between the motor drive time after escrow and the distance the paper money is conveyed by the motor (horizontal axis), with FIG. 7(*a*) particularly representing the situation prior to correcting the motor drive time after escrow, and FIG. 7(*b*) representing the situation after correcting the motor drive time after escrow.

When the measured number of pulses Pd+the motor stop pulse number Pst is smaller than the ideal pulse number c' (P'>0), as illustrated in FIG. 7(*a*), after the paper money A has passed the paper money identification sensor 18 and stopped in the escrow position (Pst), when the motor 11 is again driven and immediately stopped, insufficient feed results wherewith the paper money A is not conveyed as far as the determined position, and the distance of that feeding insufficiency can be detected beforehand by the correction pulse number P', in terms of how many pulses it is, with reference to the drive pulse number for the motor 11.

In this case, after the paper money A passes the paper money identification sensor 18 and stops at the escrow position (Psi), the motor 11 is not driven again and immediately stopped, but provision is made so that, when, as illustrated in FIG. 7(*b*), the motor 11 is stopped after being driven further by the measure of the insufficient pulses, that is, by just the correction pulse number P', after the paper money A passes the paper money identification sensor 18 and stops at the escrow position (Pst), the drive pulse number by which the motor 11 is again driven can be corrected to the ideal pulse number c' in overall terms inclusive of the inertial force, and, thereby, the trailing end of the paper money A can be stopped at the determined position.

FIGS. 7(*a*) and 7(*b*) are diagrams representing the relationship between the drive time the motor 11 is again driven after the paper money A passes the paper money identification sensor 18 and stops at the escrow position (Pst), and the distance the paper money A trailing end is conveyed by the motor 11 (horizontal axis). In FIG. 7(*a*) is represented a situation where, when, after the paper money A passes the paper money identification sensor 18 and stops at the escrow position (Pst), the motor 11 that is again driven is immediately stopped, the motor 11 is driven just the measured pulse number Pd by the inertial force. Here, that measured pulse number Pd+the motor stop pulse number Pst will be smaller than the ideal pulse number c', wherefore the trailing end of the paper money A is stopped after being fed insufficiently.

In FIG. 7(*b*), on the other hand, is represented a situation where provision is made so that, by stopping the motor 11 that has again been driven after it has been driven just the correction pulse number P', after the paper money A has passed the paper money identification sensor 18 and stopped at the escrow position (Pst), that is, the motor 11 that resulted in insufficient feed with the inertial force only, the number of motor 11 turning drive pulses after detection of the trailing end of the paper money A by the paper money identification sensor 18 is corrected so as to become the ideal pulse number c', the trailing end of the paper money A can be stopped and positioned to the degree possible at the determined position.

In FIGS. 7(*a*) and 7(*b*), in particular, situations are represented where the motor stop pulse number Pst is 2 pulses, the measured pulse number Pd is 7 pulses, the correction pulse number P' is 6 pulses, and the ideal pulse number c' is 15 pulses.

However, when the correction pulse number P' found from the Calculation Formula 2 described earlier is such that P'>N, the control means 25 alter the correction pulse number P' so that P'=N.

Thus when the correction pulse number P' is such that P'>N, that indicates that the measured number of pulses Pd found from the conveyance speed V+the motor stop pulse number Pst is far fewer than the ideal pulse number c', and that the amount of paper money A feed insufficiency is extremely large. However, when the distance between the paper money identification sensor 18 and the paper money return prevention lever 20 is taken into consideration, it is believed that, in actuality, the trailing end of the paper money A will be engaged by the paper money return prevention lever 20 (FIG. 5) if the correction pulse number P' is such that P'=N, wherefore the correction pulse number P' is corrected so that P'=N.

That is, when the calculated correction pulse number P' is such that P'>N, by stopping the motor 11 after driving it by just the number of pulses N after the paper money A passes the paper money identification sensor 18 and stops at the escrow position, the trailing end of the paper money A is stopped and positioned to the degree possible at the determined position.

When P'<0, on the other hand, the control means 25 alter the correction pulse number P' so that P'=0.

Thus, a case where P'<0 indicates that the measured number of pulses Pd found from the conveyance speed V+the motor stop pulse number Pst is greater than the ideal pulse number c', in which case, even if the motor 11 that is again driven, after the paper money A passes the paper money identification sensor 18 and stops at the escrow position (Pst), is stopped immediately, the paper money A will be sent further downstream than the determined position, resulting in the paper money A being fed too far, but the distance of that overfeeding can be detected beforehand in terms of how many pulses it is, with reference to the drive pulse number for the motor 11, by the correction pulse number P'.

In this case, furthermore, the motor 11 should be stopped at a position where the motor 11 has been driven number of pulses that is fewer by the number of pulses of overfeeding, before the paper money A passes the paper money identification sensor 18, but the control means 25 are such that they will stop the motor 11 after the paper money A passes the paper money identification sensor 18, then again drive the motor 11, and stop that drive, wherefore control cannot be effected to make P'<0, and, for that reason, the correction pulse number P' is here altered so that P'=0.

That is, provision is made so that, when P'<0, after the paper money A has passed the paper money identification sensor 18 and stopped, the drive thereof, that is, of the motor 11 that should again be driven, is stopped, and, thereby, the trailing end of the paper money A is stopped and positioned to the degree possible at the determined position.

Figure 6:
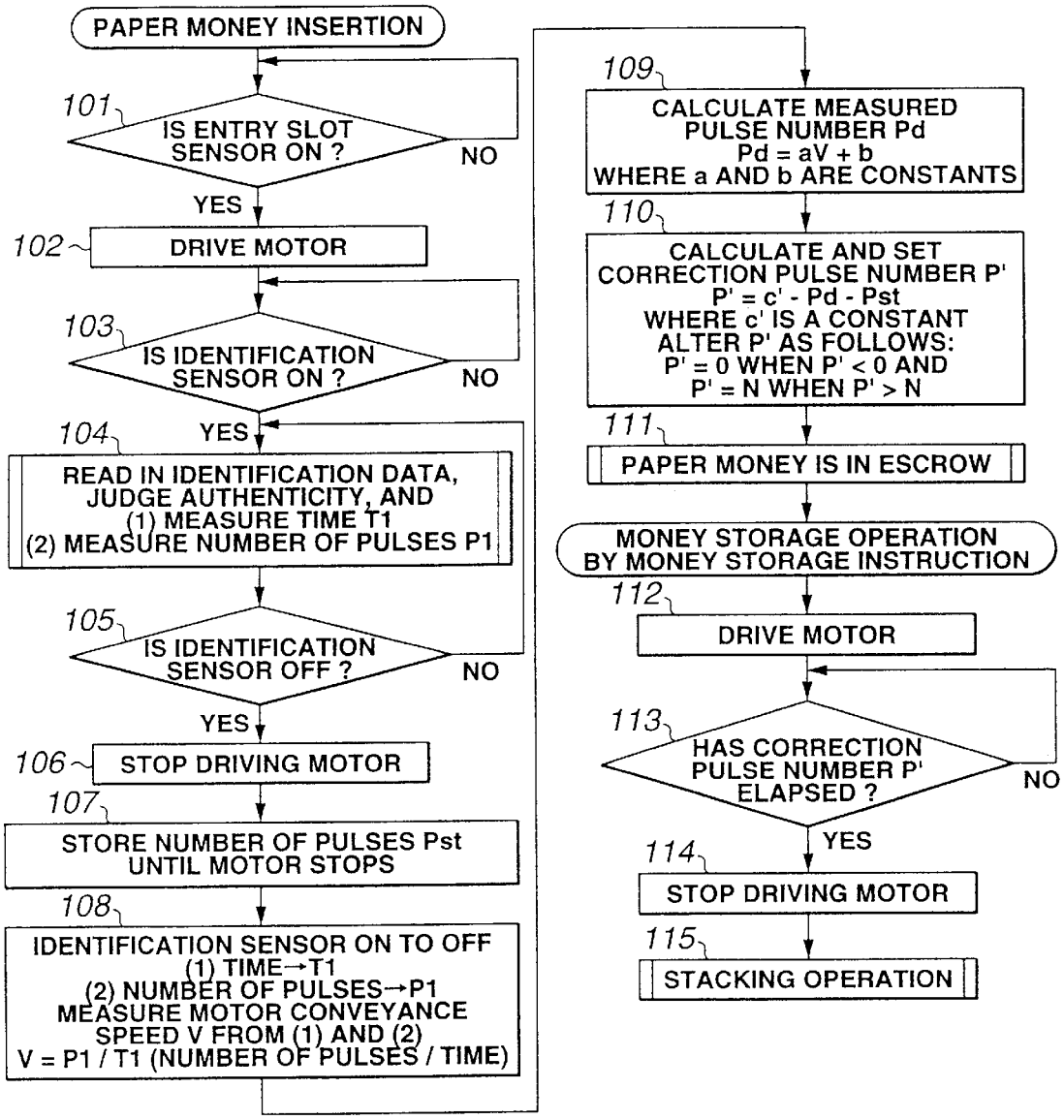
FIG. 6 is a flowchart of the processing procedures of control means for controlling the paper money feeder in another embodiment illustrated in FIG. 5.

In step 106 indicated in FIG. 6, meanwhile, the control means 25 have stopped the drive of the motor 11 in the paper money feeding means 4, wherefore the paper money feeder 50 has transitioned to the so-called paper money escrow condition where it temporarily holds the paper money A in the paper money feeding route 2 (step 111). However, while in this paper money escrow condition, if a product purchase button on the vending machine is pressed, the control means 25 will judge that a normal transaction has been performed, discharge a product from the vending machine, and transition to a money storage operation for taking the paper money A that is being temporarily held (escrowed) in the paper money feeding route 2 and accommodating it in the stacker 19.

That is, when the money storage operation is transitioned to, the control means 25 again drive the motor 11 of the paper money feeding means 4 in the forward direction (step 112), causing the paper money conveyance belt 5 to turn in the forward direction, thus guiding the paper money A further downstream, and, after driving the motor 11 (in step 113) by just the correction pulse number P' calculated as noted earlier, from the drive of the motor 11 in step 112, stop that drive (step 114).

Thus, in this paper money feeder 50 described in the foregoing, the control means 25, based on the time interval T1 required for a paper money A to pass through a certain sector in the paper money feeding route 2 positioned upstream from the paper money identification sensor 18, calculate beforehand the conveyance speed V of the motor 11 at the point in time when the trailing end of the paper money A will pass the paper money identification sensor 18, and store in memory the number of pulses the motor 11 is driven so as to turn until the paper money A passes the paper money identification sensor 18 and stops at the escrow position, that is, the motor stop pulse number Pst.

The control means 25 are made so that, based on the calculated conveyance speed V, when the motor 11 that is again driven, after the paper money A has passed the paper money identification sensor 18 and stopped at the escrow position (Pst), and the drive thereof is immediately stopped, those means calculate beforehand the measured pulse number Pd the motor 11 will be driven so that it turns by the inertial force, also calculate the driving time the motor 11 is again driven, as the correction pulse number P', from that measured pulse number Pd+the motor stop pulse number Pst stored in memory, so that the drive pulse number the motor 11 is again driven will become the ideal pulse number c', in overall terms, and control the motor 11 based on that correction pulse number P'. As a consequence, those control means 25 can stop the trailing end of the paper money A to the degree possible at the determined position, irrespective of fluctuations in the inertial force after the motor 11 drive stops, even when the load on that motor 11 fluctuates and the paper money A conveyance speed V has fluctuated due to environmental changes in temperature and the like at the installation site for the vending machine or the like comprising the paper money feeder 50 described in the foregoing, or fluctuations in the voltage supplied to the motor of the paper money feeding means 4.

Accordingly, after step 114 indicated in FIG. 6, when the control means 25 drive the pressing part of the paper money moving means 22 illustrated in FIG. 5, the paper money is guided piece by piece toward the stacker 19 (step 115), and the paper money A is definitely accommodated inside the stacker 19 and engaged definitely by the paper money return prevention lever 20. As a consequence, the danger of the paper money A failing to be engaged by the paper money return prevention lever 20 so that it interferes with paper money A accommodation operations or causes paper money jamming will be eliminated to the extent possible.

In the embodiments described above, furthermore, the paper money identification sensor 18 is configured of a pair of photosensors comprising a pair of light emitting and light receiving elements, but the present invention is not limited to or by those embodiments, and the paper money identification sensor may be configured by a plurality of pairs of photosensors comprising a plurality of pairs of light emitting and light receiving elements, may be such as detects with a plurality of light emitting elements and a single light receiving element, or may be configured by a single light emitting element and a plurality of light receiving elements, in which cases provision may be made so that one pair of photosensors comprising a pair of light emitting and light receiving elements is selected therefrom, and that pair is made the paper money identification sensor 18 in the paper money feeder 50 represented in the foregoing embodiments.

In the paper money feeders 1 and 50 in these embodiments, provision is made so that the measurement of the time interval T1 required for the paper money A to pass through the certain sector and the measurement of the number of pulses P1 by which the motor is driven during that time interval T1 are begun after the motor 11 has reached a constant speed (steady) state. In the present invention, however, the time of starting measurements is not limited thereto or thereby, and provision may be made so that measurements are started from a transition state prior to the motor 11 reaching a steady state.

With the paper money feeders 1 and 50 in these embodiments, the control means 25 are made so that they calculate the correction pulse number P for the motor 11 for all paper money A inserted through the paper money insertion slot 2*a*, and control the drive time of the motor 11 based thereon. However, the control means 25 in the paper money feeder of the present invention may be such that do not perform a motor 11 drive time control operation for all paper money A inserted through the paper money insertion slot 2*a*, but, for example, so that those control means 25 perform that motor drive time control operation only when the length of paper money A inserted through the paper money insertion slot 2*a* is shorter than a certain length.

The length of the paper money is determined based on the times the leading end and trailing end of the paper money are detected by the paper money identification sensor 18, for example.

In the paper money feeders 1 and 50 of these embodiments, provision is made so that the time interval T1 required for the paper money A to pass through the certain sector is calculated on the basis of the times the leading end and trailing end of the paper money A are detected by the paper money identification sensor 18. However, the sensor for measuring that time interval T1 is not limited to the paper money identification sensor 18, and provision may be made so that, for example, the calculation is made from a suitable range with the time from the detection of the leading end of the paper money A to the detection of the trailing end thereof by the entry slot sensor 3.

In the paper money feeders 1 and 50 of these embodiments, provision is made so that the time interval T1 required for the paper money to pass through the certain sector and the number of pulses P1 the motor 11 is driven within that time interval T1 are measured, the conveyance speed V of the motor 11 is calculated thereby, and correction pulse number P or P' is calculated based on that calculated conveyance speed V. However, in the paper money feeder of the present invention, it is not absolutely necessary to calculate the conveyance speed V of the motor 11.

Provision may be made so that, for example, the time interval T2 from the detection of the trailing end of the paper money A by the entry slot sensor 3 (when the entry slot sensor 3 turns OFF) and the detection of the trailing end of the paper money A by the paper money identification sensor 18 (when the paper money identification sensor 18 turns OFF) is measured, and, based on that measured time interval T2, the drive time for the motor 11 after the paper money A has passed either the paper money detection sensor 15 or the paper money identification sensor 18 (i.e. the correction pulse number P or P') is determined. In that case, the ratio between the distance S1 between the entry slot sensor 3 and the paper money identification sensor 18, on the one hand, and either the distance S2 between the paper money identification sensor 18 and the paper money return prevention lever 20, or the distance S3 between the paper money detection sensor 15 and the paper money return prevention lever 20, on the other, is known beforehand, wherefore the correction pulse number P or P' can be calculated from the measured time interval T2.

In the paper money feeders 1 and 50 of these embodiments, the control operation for positioning the trailing end of the paper money A is done for the purpose of definitely accommodating the paper money A in the stacker 19 and having that paper money A engaged by the paper money return prevention lever 20 to prevent paper money jamming. However, if the control operation of the paper money feeder of the present invention is done for the purpose of positioning the paper money A, it may be an apparatus that is used for some other purpose than the paper money accommodation operation described in the foregoing.

In the paper money feeders 1 and 50 of these embodiments, a paper money feeder has been described which stops the trailing end of the paper money A at a determined position. When the trailing end of the paper money A can be stopped at a determined position in this manner, paper money of different types (lengths) (such as ¥1000 notes and ¥2000 notes) can be accommodated in the same stacker 19, made to be definitely engaged by the paper money return prevention lever 20, and paper money jamming prevented.

The paper money feeder of the present invention is not limited to a paper money feeder that stops the trailing end of the paper money A at a determined position, but may be a paper money feeder that stops the leading end of the paper money at a determined position.

In the paper money feeders 1 and 50 of these embodiments, furthermore, a paper money feeder has been described which conveys the paper money A such that it is stopped at a determined position, but, needless to say, the present invention can be applied in paper sheet feeders (such as coupon conveyors or gift certificate conveyors) that perform processing which stops other types of papers (such as coupons or gift certificates, for example) at a determined position.

In the paper sheet feeder of the present invention, as described in the foregoing, a paper sheet feeder comprises: paper conveying means comprising a motor for conveying paper along a paper feeding route; a paper detection sensor provided in the paper feeding route; and control means for stopping the drive of the motor after the paper has passed the paper detection sensor and positioning the paper at a prescribed position downstream of the paper detection sensor; wherein the control means are made to control the drive time of the motor after the paper has passed the paper detection sensor based on the time required for the paper to pass through a certain sector of the paper feeding route positioned upstream from the paper detection sensor, wherefore the paper can be stopped so that the trailing ends thereof are positioned to the degree possible at a determined position, even when environmental changes in temperature and the like occur at the installation site, or fluctuations occur in the voltage supplied to the motor of the paper money feeding means, and the load on that motor fluctuates, so that the speed wherewith the paper is conveyed fluctuates and the inertial force after the motor drive is stopped fluctuates.

Thus a paper money feeder, gift certificate conveying apparatus, or other paper sheet feeder can be provided which performs stable operations.

INDUSTRIAL APPLICABILITY

The paper sheet feeder of the present invention is well suited for paper money feeders gift certificate conveying apparatuses and other paper sheet feeders wherein it is necessary to stop the trailing end of the paper at a determined position.

What is claimed is:

1. A paper sheet feeder comprising:

paper conveying means having a motor, for conveying paper of different lengths along a paper feeding route;

a paper detection sensor provided in the paper feeding route; and control means for stopping drive of the motor after the paper has passed the paper detection sensor so that the paper is stopped at a position downstream of the paper detection sensor in which a trailing end of the paper is engaged with a paper return prevention lever, and then for accommodating the paper thus stopped in a stacker, wherein the control means controls drive time of the motor after the paper has passed the paper detection sensor, based on time interval required for the paper to pass through a certain sector of the paper feeding route positioned upstream from the paper detection sensor, whereby each of the papers of different lengths stops at the position in which the trailing end of the each of the papers is engaged with the paper return prevention lever so that when the papers of different lengths thus stopped are accommodated in the stacker, the papers of different lengths can be engaged with the paper return prevention lever, thereby to prevent jamming of the papers.

2. The paper sheet feeder according to claim 1, further comprising another paper detection sensor different from the first-mentioned paper detection sensor, provided upstream from the first-mentioned paper detection sensor, wherein time interval T1 required for the paper to pass through the certain sector is calculated based on detected times at which leading end and trailing end of the paper pass the another paper detection sensor; and number of revolutions of the motor is converted to number of pulses by an encoder, and wherein the control means are adapted to:

calculate beforehand conveyance speed V of the motor at point in time when the trailing end of the paper passes the paper detection sensor, based on the detected time interval T1;

calculate beforehand measured pulse number Pd for the motor which is driven so that it turns by inertial force of the motor when the motor is stopped immediately after the paper passes the paper detection sensor, based on that calculated conveyance speed V;

calculate drive time interval for the motor after the trailing end of the paper passes the paper detection sensor until the motor is stopped as correction pulse number P so that total drive pulse number of the motor driven after the paper passes the paper detection sensor becomes equal to ideal pulse number c, from the measured pulse number Pd,; and control drive of the motor based on the correction pulse number P.

3. The paper sheet feeder according to claim 2, wherein the control means are adapted to:

calculate a conveyance speed V for the motor according to an equation $$V=P1/T1 \text{(number of pulses/time interval)}$$

where T1 is time interval required for the paper to pass through the certain sector, and P1 is number of pulses the motor is driven within the time interval T1;

calculate number of pulses Pd (measured pulse number Pd) for the motor which is driven by inertial force when the motor is stopped immediately after trailing end of the paper passes the paper detection sensor, according to a following equation $$Pd=aV+b \text{(where a and b are constants); and}$$

calculate the correction pulse number P based on the calculated measured pulse number Pd, according to an equation $$P=c-Pd \text{(where c (ideal pulse number) is a constant).}$$

4. The paper sheet feeder according to claim 1, further comprising an encoder by way of which number of revolutions of the motor is converted to number of pulses, wherein the control means are adapted to:

calculate time interval T1 required for the paper to pass through the certain sector based on detected times at which leading end and trailing end of the paper pass the paper detection sensor;

calculate beforehand conveyance speed V of the motor at point in time when the trailing end of the paper will pass the paper detection sensor, based on that detected time interval T1;

store number of pulses (motor stop pulse number) for the motor which is driven so as to turn to position where conveyance of the paper stops, that is, to an escrow position (temporary holding position), when the motor is stopped immediately at point in time when the paper passes a paper identification sensor; calculate beforehand measured pulse number Pd for the motor which is driven so as to turn by inertial force based on the calculated conveyance speed V, when the motor that is again driven after the paper passes the paper identification sensor and stops in the escrow position, is immediately stopped;

calculate, from sum of the measured pulse number Pd and the stored motor stop pulse number, a motor drive time interval from the motor is driven again until the motor is stopped, as correction pulse number P', so that drive pulse number of the motor that is driven again as a whole becomes an ideal pulse number c'; and control the motor based on the correction pulse number P'.

5. The paper sheet feeder according to claim 4, wherein the control means are adapted to:

calculate a conveyance speed V for the motor according to a following equation $$V=P1/T1 \text{(number of pulses/time interval)}$$

where T1 is time interval required for the paper to pass through the certain sector, and P1 is number of pulses the motor is driven within the time interval T1;

calculate number of pulses Pd (measured pulse number Pd) for the motor which is driven by inertial force when the motor is stopped immediately after trailing end of the paper passes the paper detection sensor, according to a following equation $$Pd=aV+b \text{ (where a and b are constants);}$$

and calculate the correction pulse number P' based on the calculated measured pulse number Pd according to a following equation $$P'=c'-Pd-Pst \text{(where c' (the ideal pulse number) is a constant, and Pst is the motor stop pulse number Pst stored in memory).}$$

* * * * *